United States Patent [19]

Klepp et al.

[11] 4,033,877

[45] July 5, 1977

[54] CYCLONE FOR REMOVING SOLID IMPURITIES FROM LIQUID IN A PUMP AND MOTOR UNIT

[75] Inventors: Christian Klepp; Günter Koll; Heinz Bernd Matthias, all of Frankenthal, Germany

[73] Assignee: Klein, Schanzlin & Becker Aktiengesellschaft, Frankenthal, Pfalz, Germany

[22] Filed: July 22, 1975

[21] Appl. No.: 598,041

[30] Foreign Application Priority Data

July 22, 1974 Germany ..... 2435127

[52] U.S. Cl. ..... 210/304; 55/337; 55/346; 210/416 R; 210/512 M; 417/354

[51] Int. Cl.[2] ..... B01D 45/12

[58] Field of Search ..... 55/337, 343, 346, 348, 55/349, 437, 439; 210/304, 416, 512 M; 417/357

[56] References Cited

UNITED STATES PATENTS

| | | | |
|---|---|---|---|
| 2,341,087 | 2/1944 | Dunham | 55/343 |
| 2,765,918 | 10/1956 | Fontein | 210/512 |
| 3,225,698 | 12/1965 | Spisiak | 417/357 |
| 3,386,588 | 6/1968 | Ades | 210/512 M |
| 3,501,900 | 3/1970 | Warner | 55/337 |
| 3,516,551 | 6/1970 | Wallen et al. | 210/512 R |
| 3,947,153 | 3/1976 | Klepp et al. | 417/365 |

FOREIGN PATENTS OR APPLICATIONS

| | | | |
|---|---|---|---|
| 885,535 | 12/1961 | United Kingdom | 210/304 |

*Primary Examiner*—Bernard Nozick
*Attorney, Agent, or Firm*—Michael J. Striker

[57] ABSTRACT

A glandless centrifugal pump and wet electric motor unit for use in fossil-fired power plants has a cover which is sealingly connected with one end of the main portion of the motor housing and contains one or more cyclone separators for solid impurities. Liquid to be relieved of solid impurities is fed into the cover by way of a tangential inlet and such liquid passes through a coarse-mesh sieve which intercepts large solid impurities before the thus filtered liquid reaches the cyclone separator or separators. The separator or separators admit cleaned liquid into a channel provided which is provided therefor in the housing of the motor. The smaller solid impurities accumulate in a chamber which can be cleaned by way of a sealable opening while the cover remains attached to the main portion of the housing. The area around the sieve becomes accessible when the cover is detached from the main portion of the motor housing; such detachment need not take place for the express purpose of removing larger impurities but rather when the attendant wishes to inspect the bearings in the motor housing.

7 Claims, 3 Drawing Figures

CYCLONE FOR REMOVING SOLID IMPURITIES FROM LIQUID IN A PUMP AND MOTOR UNIT

CROSS-REFERENCE TO RELATED APPLICATION

This application is related to our application 489,421 issued Mar. 30, 1976 as U.S. Pat. No. 3,947,153 whose entire disclosure is herewith incorporated by reference.

BACKGROUND OF THE INVENTION

The present invention relates to improvements in pump and motor units, especially to units or aggregates wherein a wet electric motor drives the impeller of a glandless centrifugal pump. Such units are used in the boilers of fossel-fired power plants and for many other purposes.

A pump and motor unit must be designed with a view to insure satisfactory operation under normal as well as under certain extreme conditions, for example, such as will arise due to continuously increasing unit output of the plant. Malfunctions of pump and motor units in such plants often arise during starting, when the unit is operated at less than normal load, when the unit is used solely for circulation of liquid and/or during acid cleaning of the boiler or boilers. Additional factors which affect the operation of pump and motor units include high temperatures and/or pressures of conveyed liquids. Still further, the operation of pump and motor units, especially units using glandless pumps and wet motors, can be adversely affected by solid impurities in the circulating fluid medium. Fluids which are circulated by pump and motor units in a fossil-fired power plant or heating plant invariably contain impurities in the form of scale, globules of weldant, rust and/or others. Such impurities are likely to clog the cooling and/or lubricating circuit of the motor, especially the wet motor of a unit which employs a glandless pump. The clogging can result in complete breakdown of the unit and/or the entire plant.

It was already proposed to install a solids-segregating device upstream of the customary high-pressure cooler in the cooling and/or lubricating circuit of the wet motor. Such proposal has met with little success because the provision of a satisfactory segregating device involves excessive initial and maintenance costs. This will be readily appreciated since the segregating device includes a large number of conduits and valves with attendant problems regarding leakage of circulating fluid. Moreover, the space requirements of a discrete segregating device are excessive in many types of plants which utilize glandless pump and wet motor units. The conduits and valves are likely to develop pockets for entrapped air. Still further, a discrete segregating device must be dismantled, together with the cooling and/or lubricating system, whenever one desires to gain access to the components of the pump and motor unit. Consequently, satisfactory segregation of solid impurities from circulating liquids in accordance with the just discussed proposal creates problems which are often much more serious than the presence of solid impurities.

SUMMARY OF THE INVENTION

An object of the invention is to provide a pump and motor unit, especially a unit which includes a wet motor and a glandless centrifugal pump whose impeller is directly coupled to the output element of the motor, with novel and improved means for reliably segregating solid impurities before such impurities can enter the motor and/or pump of the unit.

Another object of the invention is to provide a compact, simple, reliable, rugged and long-lasting solids-collecting device which can be readily installed in existing pump and motor units at a reasonable cost.

A further object of the invention is to provide a device which does not occupy additional space, which is readily accessible for evacuation of intercepted impurities and which can be inspected, taken apart and reassembled without requiring even partial dismantling of the motor, pump, cooling system and/or lubricating system of the unit.

The invention is embodied in a pump and motor unit, particularly in a glandless pump and wet electric motor unit for circulation of a liquid in a power plant whereby such liquid is at least likely to contain (and normally contains) solid impurities such as scale, rust and the like. The unit comprises a housing (e.g., an upright motor housing having a main portion open at the lower end and a cover or cap sealingly secured to the lower end of the main portion), a compartment which is defined by the cover (preferably by a cupped lower portion of the cover) and channel means extending upwardly from and communicating with the compartment, inlet means provided in the cover to admit a stream of contaminated liquid into the compartment (preferably tangentially so that the inflowing liquid circulates in the compartment), and solids-intercepting means including at least one cyclone separator mounted in the compartment to supply cleaned liquid into the channel means and to intercept solid impurities. Such solid impurities preferably accumulate in a sludge chamber which is defined by the cover at a locus remote from the channel means and can be evacuated, when necessary, by way of one or more normally sealed openings in the cover. A course-mesh sieve or screen can be mounted in the compartment around the cyclone separator or separators to intercept larger solid impurities but to allow smaller impurities and the liquid to enter the cyclone separator or separators. Larger impurities can be removed from the space around the sieve when the cover is detached from the main portion of the housing for the purpose of affording access to bearings in the motor.

The novel features which are considered as characteristic of the invention are set forth in particular in the appended claims. The improved pump and motor unit itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2, which is substantially identical to FIG. 1 of the above-cited commonly owned U.S. Pat. No. 3,947,153, shows an arrangement in which the instant invention may be incorporated. A three-phase squirrel cage induction-type wet motor has a housing H in which a rotor 12 is rotatable about an axis A. This housing H contains electromagnets 11 which cooperate with a pump disk 13 mounted on one end of the rotor 12 to form therewith a main axial-thrust bearing. In addition the rotor 12 is supported in a mechanical thrust bearing 14 of the double-acting Kingsbury type comprising a chrome-metal disk 12*a* fixed to the rotor shaft 12, annular pads 14*a* axially flanking the disk 12*a*, and annular shoes 14*b* fixed in the housing H. The confronting surfaces 15 of the disk 13 and magnets 11 can also constitute a thrust bearing.

Figure 1:
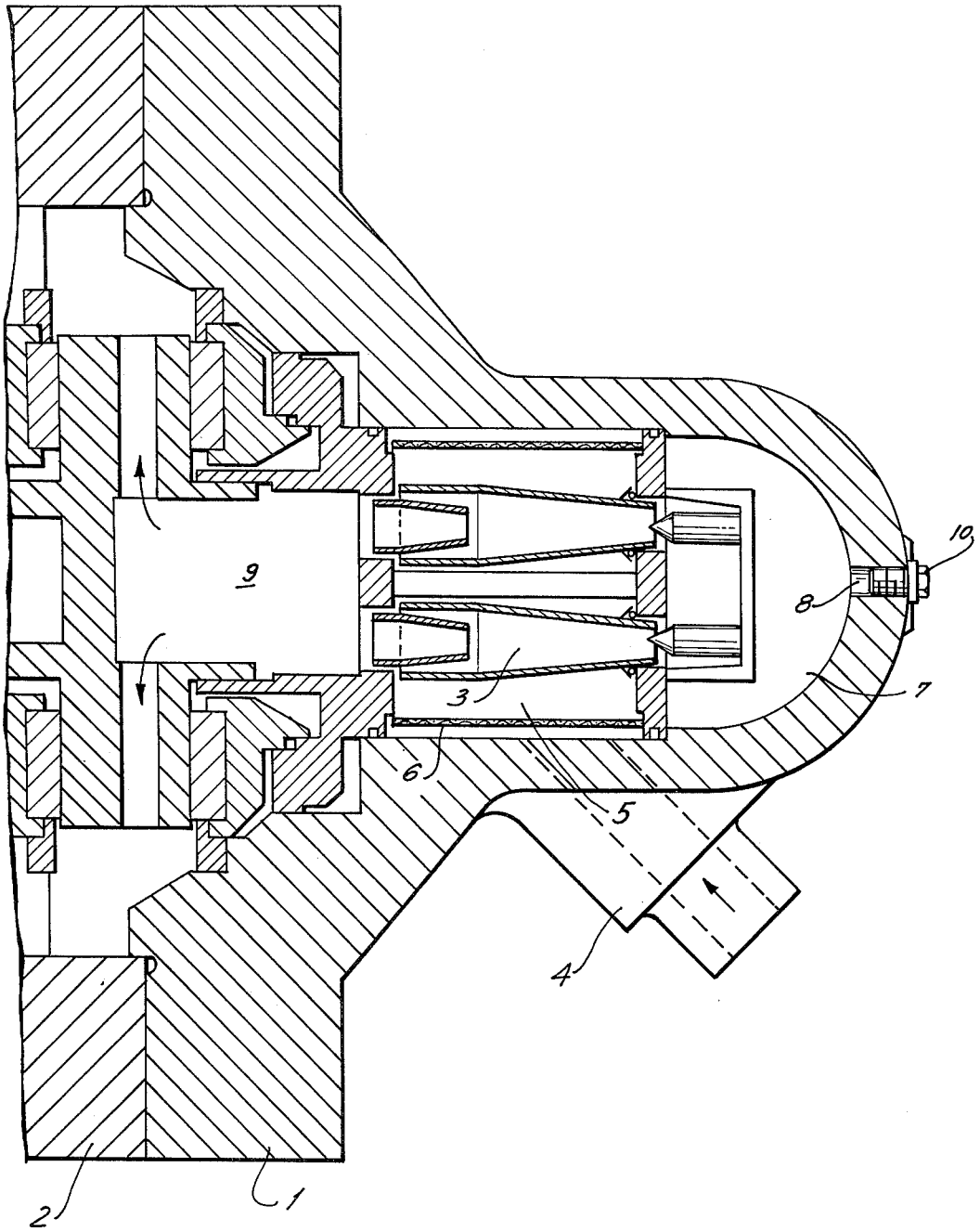
FIG. 1 is an axial section through the improvement according to the present invention.

The disk 13 is formed with at least two radially extending passages 16 which are open at their inner ends to an intake opening 18 and at their outer ends to a pump chamber 19 that communicates via gap 17 with the annular axial passage 20 extending up in the housing H around the rotor 12. The other end of this passage 20 is connected back to the intake opening 18 so that the disk 13, when rotated at high speed by the rotor 12, will cause liquid to move centrifugally outwardly in the passages 16, thereby drawing liquid in through the opening 18 and feeding it under pressure into the passage 20 via the chamber 19 and gap 17. Thus this disk 13 forms an integral coolant pump which is held within one end of the housing H.

The upright main portion 2 of the housing of the wet motor in a pump and motor unit is connected with a flange of a lower housing portion or cover 1 by bolts, screws or other suitable fastener means, not shown. The cupped lower portion of the cover 1 defines a compartment 5 for two discrete identical cyclone separators 3. The compartment 5 receives liquid to be cleaned by way of a substantially tangential inlet 4. The larger solid impurities are intercepted by a coarse-mesh sieve 6 which is installed in the compartment 5 and surrounds the cyclone separators 3. The cyclone separators segregate smaller impurities from the liquid and the thus cleaned liquid flows into a channel 9 provided in the housing portion 2 to thereupon advance through the motor and through the glandless centrifugal pump in a manner as disclosed in the application Ser. No. 489,421 now U.S. Pat. No. 3,947,153. The impurities which are segregated by cyclone separators 3 descend into a sludge chamber 7 and can be evacuated, when necessary, upon removal of a plug 10 which normally seals an evacuating opening 8. The cupped portion of the cover 1 can have two or more sealable openings.

Figure 2:
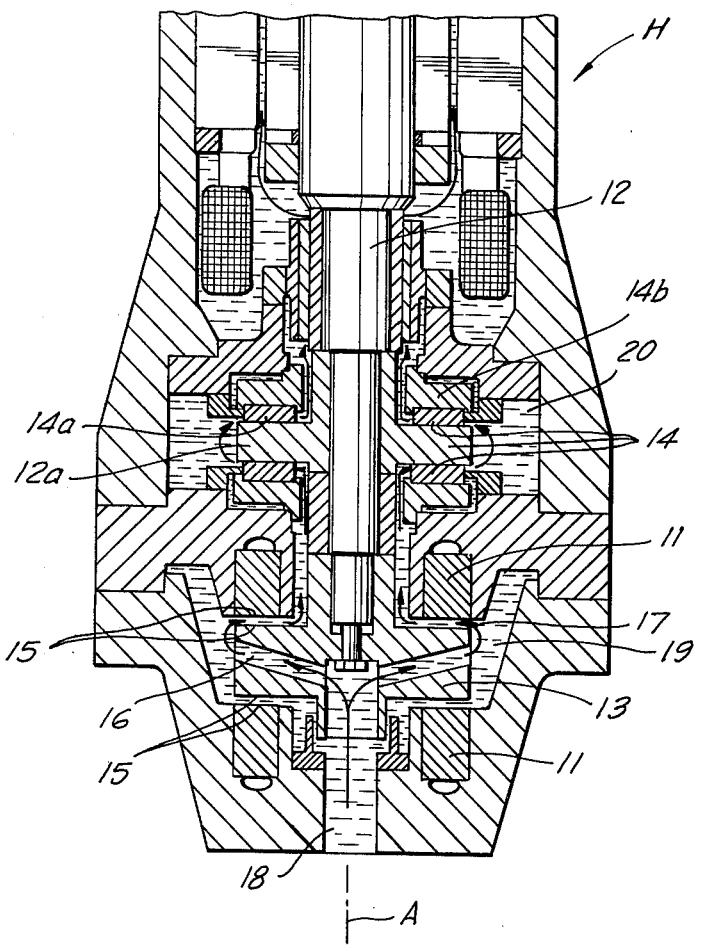
FIG. 2 PRIOR ART
FIG. 2 is an axial section through a portion of a prior-art structure in which the improvement according to the present invention is usable.
Figure 3:
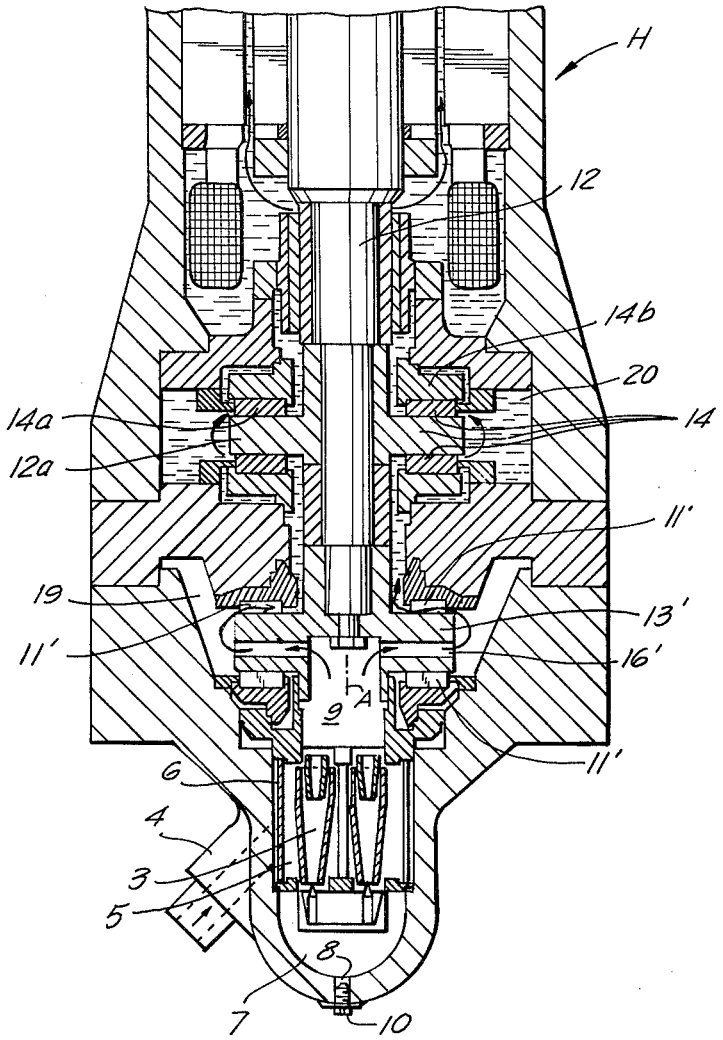
FIG. 3 is a view similar to FIG. 2 illustrating the structure of FIG. 1 in the arrangement of FIG. 2.

FIG. 3 shows the apparatus of FIG. 1 in the arrangement of FIG. 2. The same reference numerals are used in FIG. 3 as in FIGS. 1 and 2 for identical structure. Here the principal difference lies in the fact that the rotor 13' is provided with radially extending passages 16' which, instead of being inclined to the axis A as in FIG. 2 are perpendicular thereto. Furthermore the rotor 13' of the pump 9 is here shown supported in bearings 11' of the magnetic type similar to the bearings 14.

The contaminated liquid which enters the cover 1 by way of the tangentially arranged inlet 4 circulates in the compartment 5 and passes through the interstices of the sieve 6 which latter intercepts larger impurities such as scale, globules of weldant, rust and/or others. The liquid which passes through the sieve 6 entrains smaller impurities which are segregated from liquid in the one or the other cyclone separator 3. The cleaned liquid enters the channel 9 and the impurities accumulate in the sludge chamber 7. The plug 10 can be reached from without the cover 1 so that it can be removed, when necessary, while the unit is in operation.

It is clear that the improved solids-intercepting and collecting device 3, 6 can operate properly with a single cyclone separator or with more than two cyclone separators.

An important advantage of the improved device is that the impurities which accumulate in the chamber 7 can be removed while the flange of the cover 1 remains attached to the main portion 2 of the motor housing. The larger impurities which accumulate in the region around the sieve 6 can be removed at longer intervals upon detachment of the cover 1 from the main portion 2 or by causing liquid to issue from the cover by way of the inlet 4. The cover 1 is removed from the main portion 2 whenever the person in charge wishes to inspect the bearing or bearings in the interior of the motor. The impurities which accumulate in the region around the sieve 6 can be removed on such occasions, i.e., it is not necesssary to detach the cover for the specific purpose of evacuating larger impurities. The bearings which are accessible upon detachment of the cover 1 may be of the type as disclosed in our copending application Ser. No. 489,421.

Another important advantage of the improved device is that it need not include any conduits, valves and similar components which are used in aforediscussed conventional devices and are likely to present problems in connection with leakage as well as with entrapment of air in dead corners. The omission of conduits, valves and the like reduces the initial and maintenance cost as well as space requirements, which is often quite important in fossil-fired plants or like installations.

A further important advantage of the improved device is that it enhances the thermosyphon circulation of cooling and lubricating fluid. This is due to the fact that the device is installed in the interior of the motor, i.e., in the housing including the portion 2 and cover 1. The evacuation of air from the unit including the structure shown in the drawing is simpler and more reliable than in conventional units which employ discrete (externally mounted) solids-intercepting devices because the number of parts which are likely to collect and retain air bubbles is greatly reduced. Moreover, the cyclone separator or separators operate continuously whenever the unit is in use, and these separators are much less prone to malfunction than conventional separators.

If the percentage of relatively large solid impurities in the circulating liquid is low, the operators need not detach the cover 1 at all (at least not for the express purpose of removing solid impurities from the region surrounding the sieve 6). The impurities which accumulate in the chamber 7 can be evacuated while the unit is in use by the simple expedient of removing the plug 10. Thus, the area (chamber 7) which is most likely to accumulate reasonably large quantities of impurities can be reached and cleaned while the cover 1 remains properly attached to the main portion 2.

The sieve 6 constitutes an optional but desirable feature of the improved device. This also applies for tangential mounting of the inlet 4. Such mounting insures that the liquid enters the cyclone separator or separators at an elevated speed.

Without further analysis, the foregoing will so fully reveal the gist of the present invention that others can, by applying current knowledge, readily adapt it for various aplications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims:

1. In a motor having:

a housing having a housing end;

a cover at said housing end forming therewith a compartment having an inlet, a rotor rotatable in said housing about an axis and having a rotor end at said housing end, a bearing in said housing end supporting said rotor end for rotation of said rotor about said axis, and means including a pump connected to said rotor end and having an intake at said compartment for drawing liquid in through said inlet and through said compartment on rotation of said rotor in said housing, the improvement comprising:

solids-intercepting means including at least one cyclone separator in said compartment for intercepting solid impurities from said liquid and for feeding cleaned liquid to said intake of said pump.

2. The improvement defined in claim 1, wherein said intercepting means includes two such separators.

3. The improvement defined in claim 1 wherein said cover is formed with a sealable opening and is provided with a plug normally closing said opening, whereby access can be gained to said compartment through said opening after removal of said plug for removal of solids trapped by said cyclone separator.

4. The improvement defined in claim 1 wherein said inlet extends tangentially of said compartment, whereby liquid is angularly circulated in said compartment after being drawn in through said inlet.

5. The improvement defined in claim 1 wherein said intercepting means further includes a sieve screen between said inlet and said cyclone in said compartment, whereby some large impurities are intercepted by said screen.

6. The improvement defined in claim 1 wherein said axis is upright and said housing and rotor ends are the lower ends of said housing and said rotor.

7. The improvement defined in claim 1 wherein said cover is cup-shaped and has a flange secured to said housing end, said inlet being formed in said cover and directed at an acute angle to said axis.

* * * * *